US007361023B2

(12) United States Patent
Wu

(10) Patent No.: US 7,361,023 B2
(45) Date of Patent: Apr. 22, 2008

(54) ELECTRICAL CONNECTOR

(75) Inventor: Tsu-Yang Wu, Tu-cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/646,834

(22) Filed: Dec. 27, 2006

(65) Prior Publication Data

US 2007/0155229 A1 Jul. 5, 2007

(30) Foreign Application Priority Data

Dec. 29, 2005 (TW) ..... 94147112 A

(51) Int. Cl.
*H01R 12/00* (2006.01)

(52) U.S. Cl. ..... 439/66; 439/862

(58) Field of Classification Search ..... 439/66, 439/74, 591, 862
See application file for complete search history.

(56) References Cited

U.S. PATENT DOCUMENTS 4,354,729 A * 10/1982 Grabbe et al. ..... 439/862
4,645,279 A * 2/1987 Grabbe et al. ..... 439/68
4,940,432 A * 7/1990 Consoli et al. ..... 439/862
5,152,694 A * 10/1992 Bargain ..... 439/66
5,306,163 A * 4/1994 Asakawa ..... 439/74
5,746,626 A * 5/1998 Kwiat et al. ..... 439/630
6,299,458 B1 * 10/2001 Yamagami et al. ..... 439/66
6,540,526 B2 * 4/2003 Toda ..... 439/66
7,156,706 B2 * 1/2007 Brown et al. ..... 439/862
2001/0012739 A1 * 8/2001 Grube et al. ..... 439/862

* cited by examiner

*Primary Examiner*—Briggitte Hammond
(74) *Attorney, Agent, or Firm*—Wei Te Chung

(57) ABSTRACT

An electrical connector (1) for electrically connecting between first and second PCBs comprises a housing (20) and a number of terminals (10) received in the housing. The terminal defines a longitudinal base portion (11), a spring arm (16) extending upwardly from an upper portion thereof, and a contacting portion (18) formed at a distal end of the spring arm. The base portion defines at least two soldering portion (12, 13, 14) along the longitudinal direction thereof. The soldering portions are soldered onto the first PCB and keep the terminal balance when the second PCB presses onto corresponding contacting portion of the terminal. Thereby mechanical and electrical connection between the first and second PCBs via the connector is obtained.

9 Claims, 5 Drawing Sheets

ELECTRICAL CONNECTOR

BACKGROUND OF THE INVENTION

1. Field of the Invention

The present invention relates to electrical connectors used for hard disk, and more particularly to an electrical connector used for electrically interconnecting electronic assemblies such as printed circuit boards (PCBs).

2. Description of the Prior Art

Electrical connectors are widely used in electronic devices such as hard disk to provided to electrically connect printed circuit boards (PCBs). The connector generally comprises an insulative housing and a plurality of terminals received in the housing. Referring to FIG. 5, such a conventional terminal 90 of the connector (not shown) typically comprises a longitudinal base portion 91 adapted for securing the terminal 90 in the connector. A soldering portion 92 is formed at a distal end of the base portion 91, for soldering the terminal 90 on a first printed circuit board (PCB) (not shown) via SMT. The base portion 91 defines a first surface 912 adjacent to the first PCB. The soldering portion 92 defines a soldering surface 921 spaced from and parallel to the first surface 912 relative to the first PCB. A deflectable arm 93 extends upwardly and continuously from an upper portion opposite to the first surface 912 of the base portion 92. A contacting portion 94 is formed on a distal end of the deflectable arm 93 for electrically connecting a second PCB. The electrical connector engages with the first and second PCB via the soldering portion 92 and the contacting portion 94, respectively. As a result, mechanical and electrical engagement between the two PCBs via the electrical connector is attained.

However, when the electrical connector is engaged with the first PCB via soldering the soldering portion 92 onto the first PCB, a space is formed between the first surface 912 of the terminal 90 and the first PCB. At this time, the terminal 90 is connected with the first PCB only via the soldering portion 92. When the second PCB presses upon the contacting portion 94 of the terminal 90 to obtain electrical connection between the electrical connector and the second PCB, the press applied of the second PCB is only supported on the terminals 90 of the connector. Because the soldering portion 92 is formed at one distal end of the base portion 91 and a space is between the base portion 91 and the first PCB, when the press applied on the terminals 90 is too great, the soldering portion 92 will can not support all of the press and make the terminal 90 lose balance to incline toward to the first PCB. Thus, electrical connection between the second PCB and the contacting portion 94 of the terminal 90 is not obtained.

Thus, there is a need to provide a new electrical connector that overcomes the above-mentioned problems.

SUMMARY OF THE INVENTION

Accordingly, an object of the present invention is to provide an electrical connector used for hard disk, which has a reinforcement terminal, wherein the terminal is configured to securely and reliably mounted onto a printed circuit board (PCB) during a solder reflow process by providing reliable soldering portions soldered on the PCB.

To fulfill the above-mentioned object, an electrical connector in accordance with a preferred embodiment of the present invention comprises an insulative housing and a plurality terminals received in the housing. A multiplicity of passageways is defined through an upper portion and bottom portion of the housing, for receiving a corresponding number of the terminals therein. The terminal comprises a longitudinal base portion received in corresponding passageway of the housing, a spring arm, with two continuous curved members, extending upwardly from an upper portion of the base portion and a contacting portion formed at a distal end of the spring arm. The base portion defines at least two soldering portions in turn at longitudinally opposite two ends toward to a first printed circuit board (PCB).

When the first PCB electrically connects to the second PCB via the connector, firstly, soldering the soldering portions of the terminal onto corresponding pads of the first PCB, then making pads of the second PCB attach onto corresponding contacting portions to obtain connection between the terminals and the second PCB. The press applied by the second PCB is completely supported on the soldering portions to make the connector keep balance relative to the first PCB so that the connector is securely and reliably mounted onto the first PCB. Which can prevent the connector from inclining downwardly toward to the first PCB during undergoing too great press applied by the second PCB.

Other objects, advantages and novel features of the present invention will become more apparent from the following detailed description when taken in conjunction with the accompanying drawings, in which:

DESCRIPTION OF PREFERRED EMBODIMENT OF THE INVENTION

Reference will now be made to the drawings to describe the present invention in detail.

Referring to FIGS. 1-4, an electrical connector 1 in accordance with the preferred embodiment of the present invention is used for hard disk and provided for electrically connecting circuit substrates, such as printed circuit board (PCB) (not shown). The connector 1 comprises a generally rectangular insulative housing 20 and a multiplicity of contacts 10 received in the housing 20.

Figure 1:
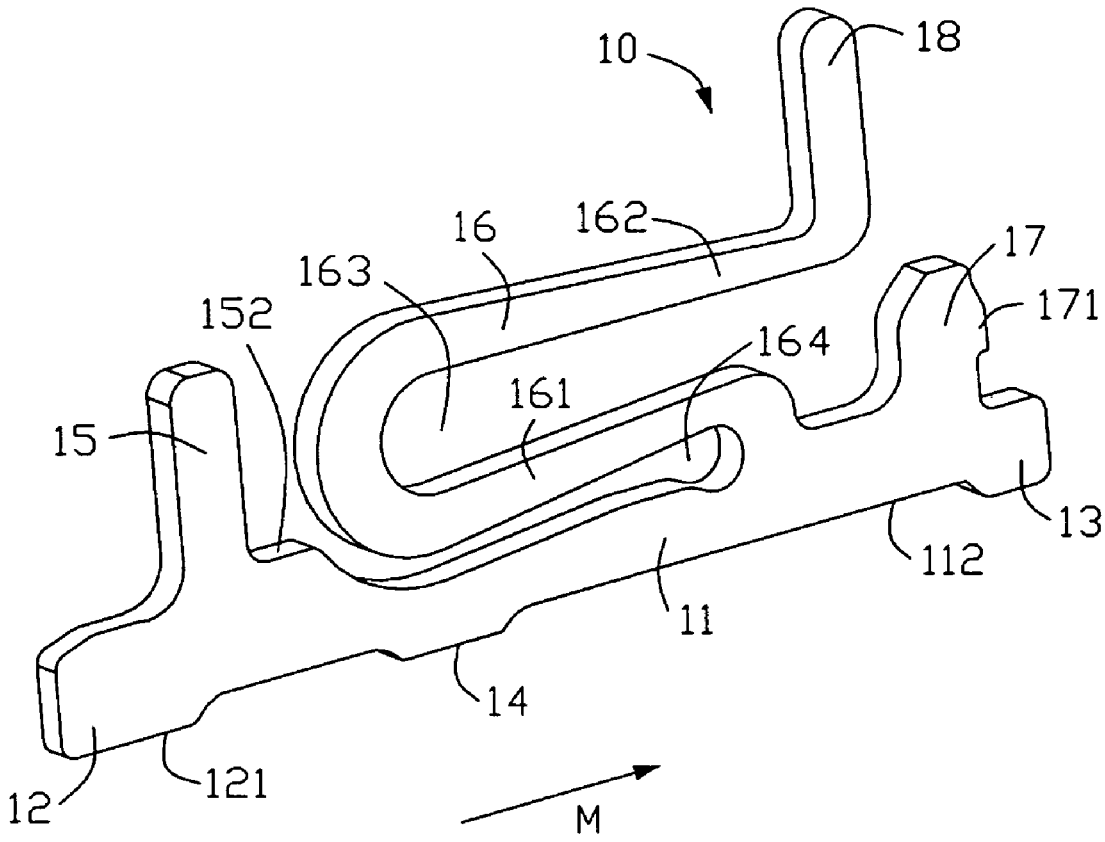
FIG. 1 is an isometric view of a terminal of an electrical connector in accordance with a preferred embodiment of the present invention.
Figure 2:
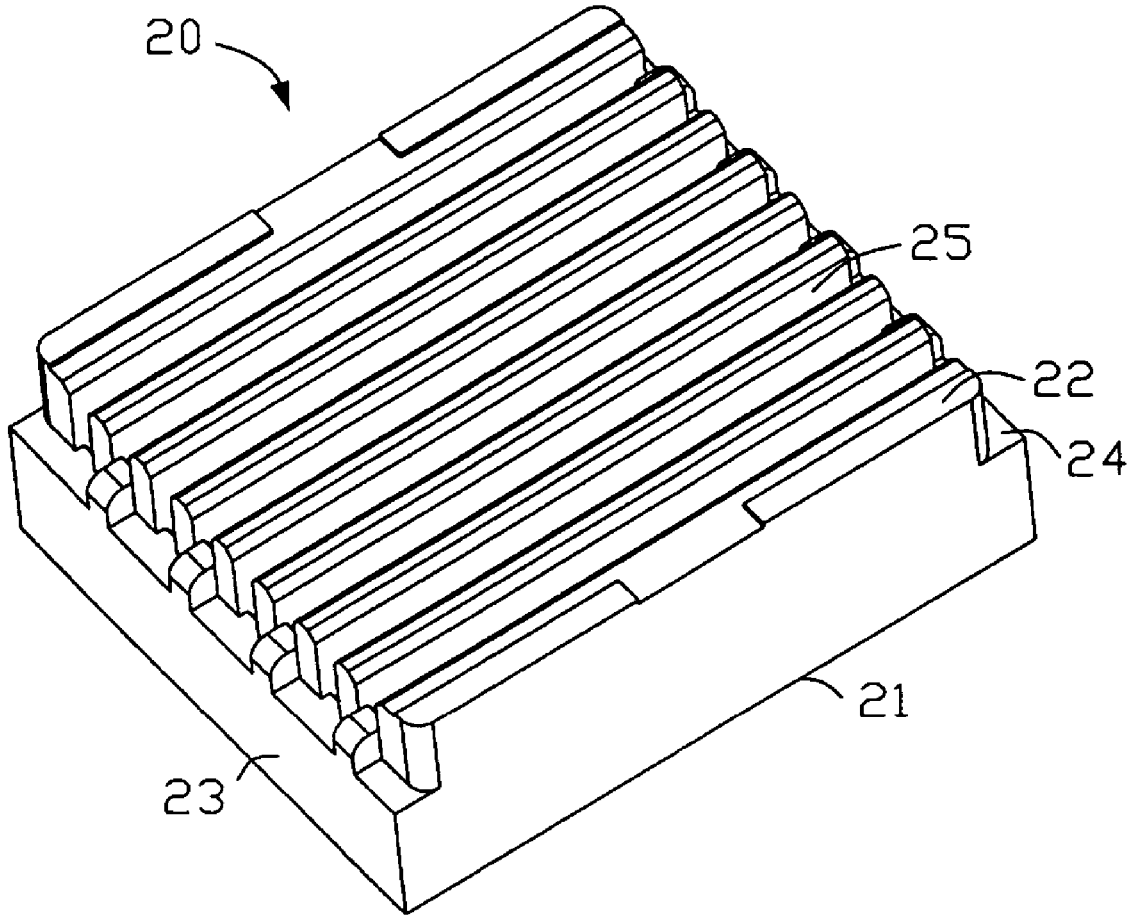
FIG. 2 is an isometric view of a housing of the electrical connector in accordance with a preferred embodiment of the present invention.

FIG. 1 is an isometric view of the terminal 10 of the connector 1 in accordance with the preferred embodiment of the present invention. The terminal 10 comprises a longitudinal base portion 11, and a securing portion 15, a spring arm 16 and a protrusion 17 in turn extending upwardly from an upper portion of the base portion 11 along a longitudinal direction thereof as shown by arrow M. The base portion 11 defines a bottom surface 112 opposite to the upper portion. A first and second soldering portions 12, 13 project downward from the bottom surface 112 at two opposite bottom ends thereof, and a third soldering portion 14 likewise projects downward from the bottom surface 112 between the first and second soldering portions 12, 13. The first, second and third soldering portions 12, 13, 14 each defines a soldering surface 121 thereof. A space is formed between the soldering surface 121 and the bottom surface 112.

The securing portion 15 is formed adjacent to the first soldering portion 12, while the protrusion 17 is formed adjacent to the second soldering portion 13 and the spring arm 16 is formed between the second portion 13 and the third soldering portion 14. The spring arm 16 with a first and second continuous and inverted U-shaped configurations 163, 164, extending upwardly from an upper portion of the base portion 11 and a contacting portion 18 extended upwardly and perpendicularly from a distal end of the spring arm 16. The first and the second U-shaped configurations 163, 164 are connected by a first connecting arm 161, while the first U-shaped configuration and the contacting portion 18 is connected by a second connecting arm 162. The third soldering portion 14 is formed under the first U-shaped configuration 163. The base portion 11 defines an engagement surface 152 at a portion between the securing portion 15 and the first U-shaped configuration 163. The protrusion 17 defines a barb 171 at a sidewall adjacent to the second soldering portion 13.

Figure 3:
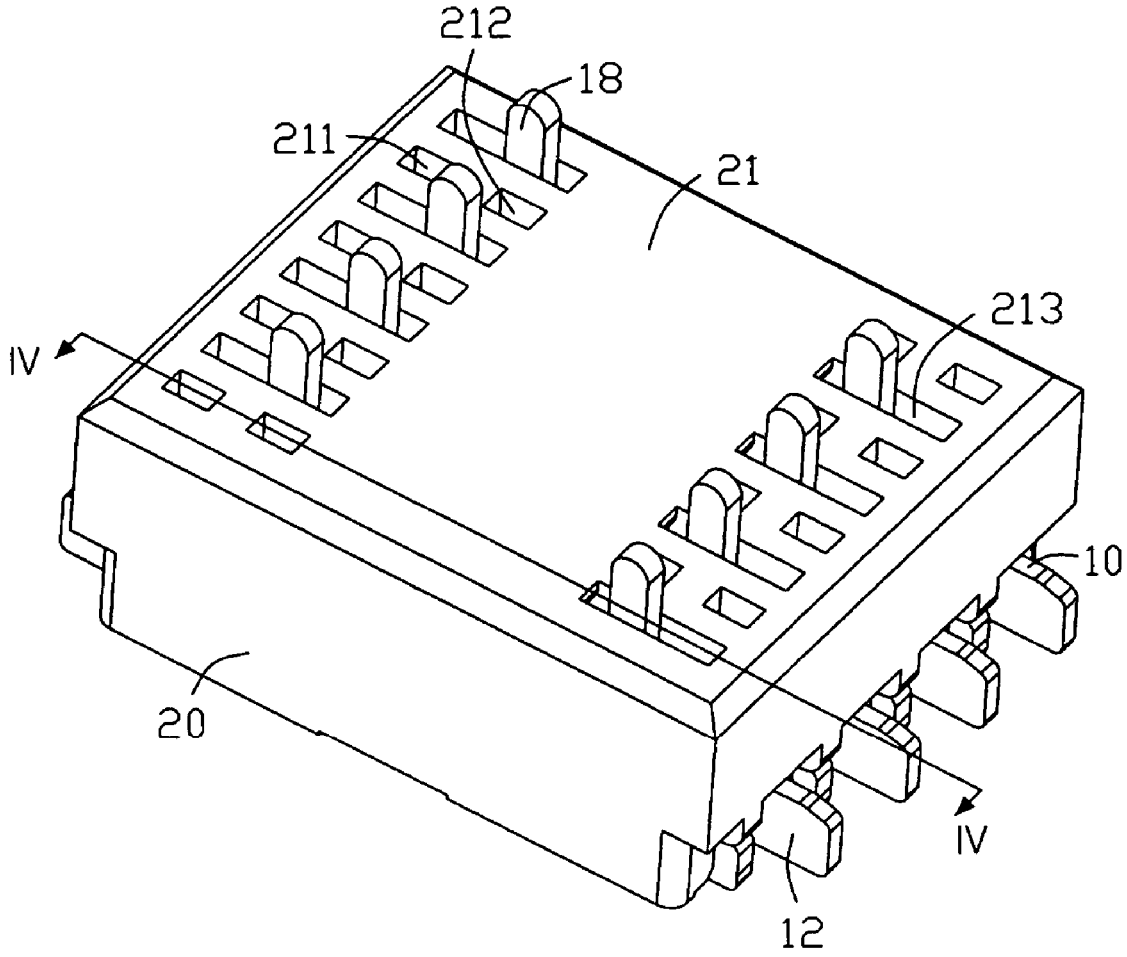
FIG. 3 is an assembly view of FIGS. 1 and 2, showing a housing inverted.

Referring to FIG. 3, the housing 20 is inverted and defines an upper face 21, a lower face 22 parallel and opposite to the upper face 21, two opposite side faces 23 perpendicular to the upper and lower faces 21, 22, and a middle face 24 parallel and between the upper and lower faces 21, 22. A plurality of passageways 25 is defined through the upper and lower faces 21, 22 and runs through from one of the two opposite side faces 23 to the other, for receiving a corresponding terminal 10 in the housing 20.

Figure 4:
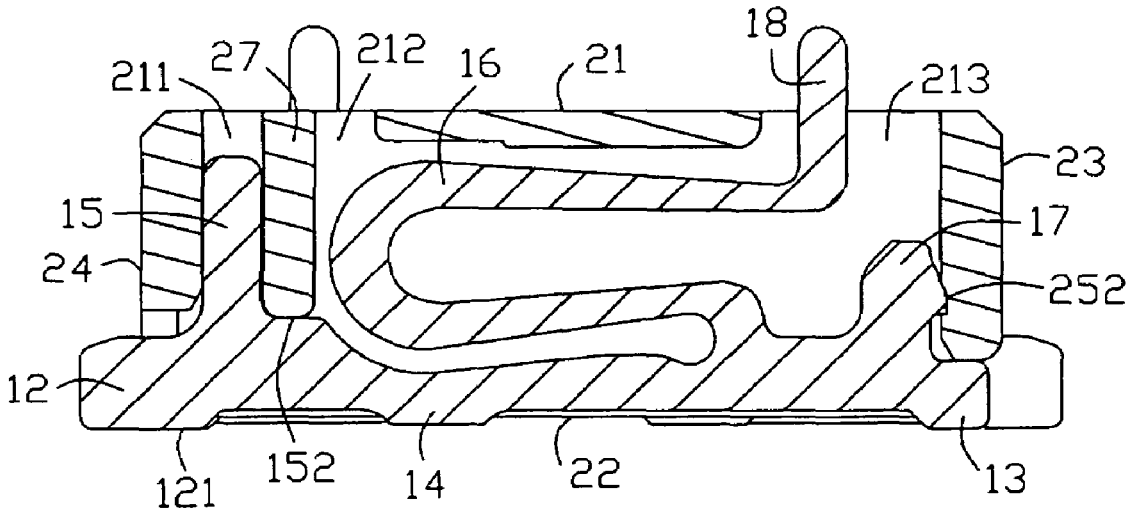
FIG. 4 is a cross section view along line IV-IV of FIG. 2.
Figure 5:
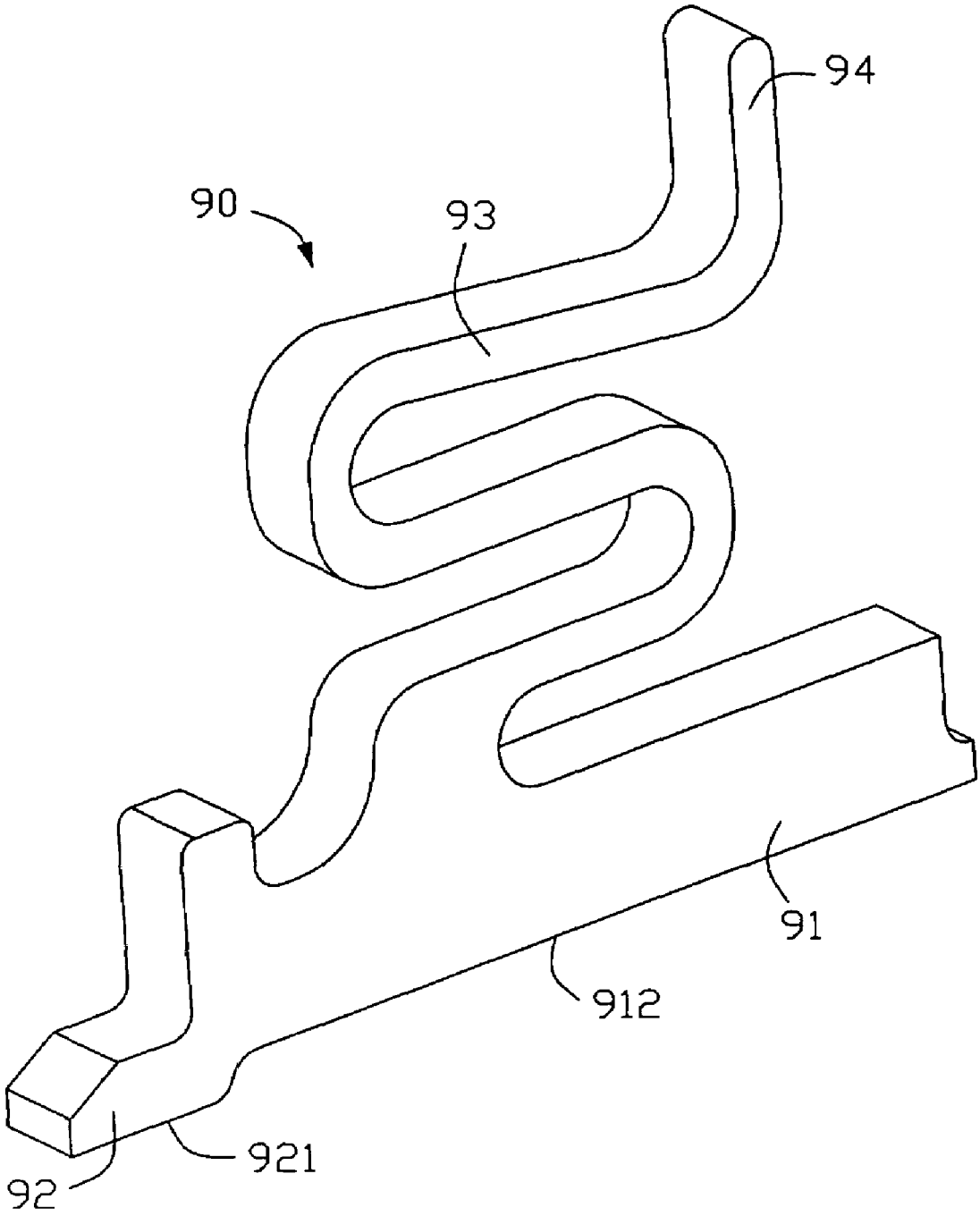
FIG. 5 (Prior Art)
FIG. 5 is an isometric view of a conventional terminal.

Referring to FIGS. 3 and 4, each two adjacent passageways 25 are formed reversedly staggeredly through the upper and lower faces 21, 22. The passageway 25 comprises a first opening 211, a second opening 212 and a third opening 213 formed on the upper face 21. A sidewall 27 is formed between the first opening 211 and the second opening 212 to interferentially receive the securing portion 15 of the terminal 10 in the first opening 211 via attaching onto the engagement surface 152. The third opening 213 communicates with the second opening 212 and defines a recess 252 in an inner wall corresponding to the barb 171 of the terminal 10, together for receiving the spring arm 16 and the protrusion 17 therein.

When the terminal 10 is inserted into the corresponding passageway 25 of the hosing 20 from the lower face 22 toward to the upper face 21, the securing portion 15 of the terminal 10 interferentially inserts into the first opening until the sidewall 27 attaches onto the engagement surface 152, at the same time, the barb 171 fittingly is engaged with the recess 252 of the third opening 213. The spring arm 16 is likewise received in the second and third openings 212, 213 and the contacting portion 18 extends out of the upper face 21 from the third opening 213, while the first, second and third soldering portions 12, 13, 14 extend out of the lower face 22. Thus, the assembly between the terminal 10 and the housing 20 is completed.

When the connector 1 is connected with a first PCB (not shown), the connector 1 is soldered on the first PCB with the first, second and third soldering portions 12, 13, 14 of the terminal 10 being soldered on corresponding contact pads of the first PCB together. The mating force between the connector 1 and the first PCB is increased, thereby securely and reliably electrical connection between the connector 1 and the first PCB is obtained. When the contacting portion 18 of the terminal 10 is pressed by a corresponding pad of a second PCB (not shown), even if the press applied on the contacting portion 18 is too great, the press will be supported by the first, second and third soldering portions 12, 13 and 14. The connector 1 does not incline downwardly toward to the first PCB because of the connecting force between the first, second, third soldering portions 12, 13, 14 and the first PCB.

As will be appreciated from the foregoing description, the base portion 11 of the terminal 10 defines three soldering portions 12, 13, 14 in turn on the bottom surface 112. Rather than defining three soldering portions, the base portion 11 of the terminal 10 may alternatively only define two soldering portion 12, 13 at two opposite bottom ends, or more than one soldering portion between the first and second soldering portions 12, 13. Whatever combination way between the first and second soldering portions 12, 13 takes, it can increase the connecting force between the connector 1 and the first PCB and prevent the connector 1 from inclining downwardly when the second PCB presses upon.

Although the present invention has been described with reference to particular embodiments, it is not to be construed as being limited thereto. Various alterations and modifications can be made to the embodiments without in any way departing from the scope or spirit of the present invention as defined in the appended claims.

What is claimed is:

1. An electrical connector comprising: an insulative housing defining an upper face, a lower face and a plurality of passageways formed through the upper face and the lower face;

a plurality of electrical terminals reversedly staggeredly received in corresponding passageways of the housing, each of the terminals defining a longitudinal base portion, a spring arm extending upwardly from an upper portion of the base portion and a contacting portion extending upwardly and outwardly of the upper face of the housing from the spring arm, the base portion defining at least two opposite soldering portions;

wherein the at least two soldering portions are respective defined at two opposite ends of the base portion;

wherein a third soldering portion is defined between the two opposite ends of the base portion;

wherein the terminal comprises a securing portion and a protrusion extending upwardly from the base portion, and the spring arm is situated between the securing portion and the protrusion;

wherein the passageway comprises a first opening, a second opening and a third opening formed on the upper face;

wherein the second opening and the third opening communicate with each other and receive the spring arm and the protrusion.

2. The connector as claimed in claim 1, wherein a sidewall is formed between the first opening and the second opening to interferentially receive the securing portion of the terminal in the first opening.

3. The connector as claimed in claim 1, wherein the spring arm comprises a first and a second substantially continuous and inverted U-shaped configurations.

4. The connector as claimed in claim 3, wherein the spring arm comprises a lower connecting arm connecting the first and the second U-shaped configurations and an upper connecting arm.

5. The connector as claimed in claim 3, wherein the base portion defines an engagement surface at a portion between the securing portion and the first U-shaped configuration, and the protrusion defines a barb at a sidewall thereof adjacent to one of the at least two soldering portions.

6. An electrical connector comprising:

an insulative housing defining a plurality of passageways therein, each of two adjacent passageways reversedly formed therethrough, the passageway defining a first, second and third openings in turn therein, the first and second openings partitioned by a sidewall, and the second opening and the third opening communicated therewith; a plurality of electrical terminals received in corresponding passageway of the housing, each of the terminals defining a longitudinal base portion, a spring arm extending upwardly from an upper portion of the base portion, a securing portion and a contacting portion; wherein the securing portions and contacting portions received in corresponding first openings and third openings, the contacting portions extending out of an upper face of the housing; wherein said base portion defines at least two soldering portions extended downwardly at two opposite ends thereof;

wherein the terminal comprises a protrusion extending upwardly from the base portion, and the spring arm is situated between the securing portion and the protrusion;

wherein the first opening, the second opening and the third opening formed on the upper face;

wherein the second opening and the third opening communicate with each other and receive the spring arm and the protrusion.

7. The connector as claimed in claim 6, wherein a plurality of soldering portions is defined between the two opposite ends of the base portion.

8. The connector as claimed in claim 7, wherein the spring arm, with a first and second continuous and inverted U-shaped configurations, extending upwardly from the upper portion of the base portion and the contacting portion extended upwardly and perpendicularly from a distal end of the spring arm.

9. An electrical connector comprising:

an insulative housing; a row of passageways vertically extending through the housing;

a plurality of contacts disposed in the corresponding passageways, respectively, each of said contacts defining a base having two opposite soldering sections located at two opposite ends thereof and exposed to an exterior outside of the corresponding passageway, a securing portion upwardly extending about one end of the base and into a retention slot in the corresponding passageway, a protrusion upwardly extending from the other end of the base and latched to a corresponding wall of the housing, a curved section upwardly extending from middle portion of the base with an engagement tip extending above an upper face of the housing;

wherein the neighboring contacts are alternately reversely arranged with one another along a row direction of said row of passageways;

wherein a distance between said two opposite soldering sections is not less than a dimension of the housing in a transverse direction along which said passageway extends.

* * * * *